US008623578B2

(12) United States Patent
Wu et al.

(10) Patent No.: US 8,623,578 B2
(45) Date of Patent: Jan. 7, 2014

(54) TETRAARYL POLYCARBONATE CONTAINING PHOTOCONDUCTORS

(75) Inventors: Jin Wu, Pittsford, NY (US); Kenny-Tuan T Dinh, Webster, NY (US); Than Sorn, Walworth, NY (US); Robert W Hedrick, Spencerport, NY (US); Linda L Ferrarese, Rochester, NY (US); Marc J Livecchi, Rochester, NY (US); Lanhui Zhang, Webster, NY (US); Lin Ma, Pittsford, NY (US); Stanley J Pietrzykowski, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 13 days.

(21) Appl. No.: 13/490,362

(22) Filed: Jun. 6, 2012

(65) Prior Publication Data

US 2013/0330665 A1 Dec. 12, 2013

(51) Int. Cl.
*G03G 5/05* (2006.01)

(52) U.S. Cl.
CPC ..... *G03G 5/0564* (2013.01)
USPC ..... 430/59.6; 430/96

(58) Field of Classification Search
USPC ..... 430/59.6, 96
See application file for complete search history.

(56) References Cited

U.S. PATENT DOCUMENTS

| | | | | |
|---|---|---|---|---|
| 5,215,843 | A | 6/1993 | Aizawa | |
| 5,281,689 | A * | 1/1994 | Bendler et al. | 528/196 |
| 5,382,489 | A * | 1/1995 | Ojima et al. | 430/59.6 |
| 5,604,063 | A * | 2/1997 | Endo et al. | 430/59.6 |
| 5,725,982 | A * | 3/1998 | Nogami et al. | 430/59.6 |
| 7,498,108 | B2 | 3/2009 | Wu et al. | |
| 7,799,494 | B2 | 9/2010 | Wu et al. | |
| 7,811,732 | B2 | 10/2010 | Wu | |
| 7,897,311 | B2 | 3/2011 | Wu | |
| 2004/0254327 | A1 * | 12/2004 | Boyles et al. | 528/86 |
| 2008/0021177 | A1 * | 1/2008 | Boyles et al. | 525/462 |

FOREIGN PATENT DOCUMENTS

JP 07295250 A * 11/1995 ..... G03G 5/05

OTHER PUBLICATIONS

English language machine translation of JP 07-295250 (Nov. 1995).*

* cited by examiner

*Primary Examiner* — Christopher Rodee
(74) *Attorney, Agent, or Firm* — Eugene O. Palazzo

(57) ABSTRACT

A photoconductor that includes, for example, a supporting substrate, an optional ground plane layer, an optional hole blocking layer, an optional adhesive layer, a photogenerating layer, and a charge transport layer, and where the charge transport layer contains a mixture of a charge transport component and a tetraaryl polycarbonate.

18 Claims, 1 Drawing Sheet

TETRAARYL POLYCARBONATE CONTAINING PHOTOCONDUCTORS

Disclosed herein are photoconductors comprised of a photogenerating layer and a charge transport layer comprised of a mixture of a charge transport component and a tetraaryl polycarbonate.

BACKGROUND

Photoconductors that include certain photogenerating layers and specific charge transport layers are known. While these photoconductors may be useful for xerographic imaging and printing systems, many of them have a tendency to deteriorate, and thus have to be replaced at considerable costs and with extensive resources. A number of known photoconductors also have a minimum of, or lack of, resistance to abrasion from dust, charging rolls, toner, and carrier. For example, the surface layers of photoconductors are subject to scratches, which decrease their lifetime, and in xerographic imaging systems adversely affect the quality of the developed images. While used photoconductor components can be partially recycled, there continues to be added costs and potential environmental hazards when recycling.

Thus, there is a need for photoconductors with extended lifetimes and reduced wearing characteristics.

There is also a need for light shock and ghost resistant photoconductors with excellent or acceptable mechanical characteristics, especially in xerographic systems where biased charging rolls (BCR) are used.

Photoconductors with excellent cyclic characteristics and stable electrical properties, stable long term cycling, minimal charge deficient spots (CDS), and acceptable lateral charge migration (LCM) characteristics are also desirable needs.

Further, there is a need for photoconductors with suppressed J zone parking deletion, which prevents or minimizes oxidation of the charge transport compounds present in the charge transport layer by nitrous oxide ($NO_x$) originating from xerographic corotron devices.

Another need relates to the provision of photoconductors which simultaneously exhibit excellent photoinduced discharge and charge/discharge cycling stability characteristics (PIDC) and improved bias charge roll (BCR) wear resistance in xerographic imaging and printing systems.

Moreover, there is a need for scratch resistant photoconductive surface layers.

These and other needs are believed to be achievable with the photoconductors disclosed herein.

SUMMARY

Disclosed is a photoconductor comprising a supporting substrate, a photogenerating layer, and a charge transport layer, and wherein said charge transport layer contains a charge transport compound and a tetraaryl polycarbonate.

Further disclosed is a photoconductor comprised in sequence of a supporting substrate, a hole blocking layer thereover, a photogenerating layer, and a charge transport layer comprised of a mixture of an aryl amine hole transport compound and a tetraaryl polycarbonate as represented by the following formulas/structures wherein m is from about 65 to about 85 mol percent, and n is from about 15 to about 35 mol percent, and the total thereof is 100 mol percent.

Also disclosed is a photoconductor comprising a supporting substrate, a hole blocking layer thereover, a photogenerating layer, and a hole transport layer comprised of a mixture of a hole transport compound and a tetraaryl polycarbonate, and which photoconductor possesses a wear rate of from about 35 to about 55 nm/kcycle.

FIGURES

There are provided the following Figures to further illustrate the photoconductors disclosed herein.

EMBODIMENTS

In embodiments of the present disclosure, there is illustrated a photoconductor comprising an optional supporting substrate, a photogenerating layer, and a tetraaryl polycarbonate containing charge transport layer.

Figure 1:
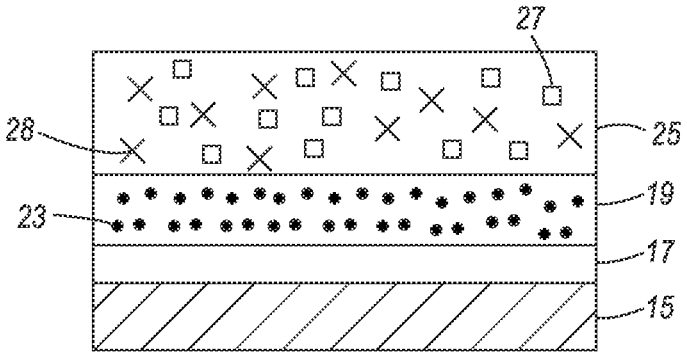
FIG. 1 illustrates an exemplary embodiment of a layered photoconductor of the present disclosure.
Figure 2:
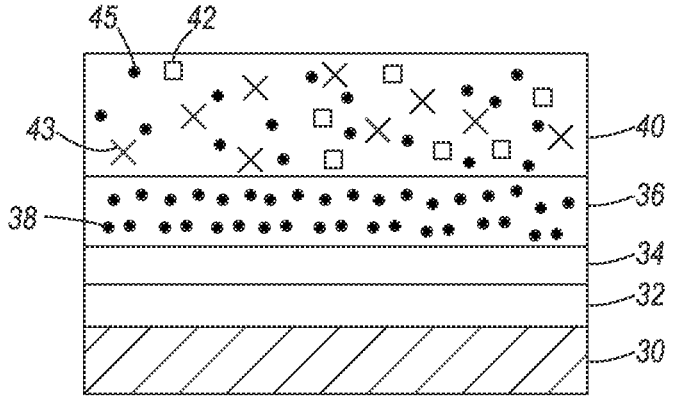
FIG. 2 illustrates an exemplary embodiment of a layered photoconductor of the present disclosure.

Exemplary and non-limiting examples of photoconductors according to embodiments of the present disclosure are depicted in FIGS. 1 and 2.

In FIG. 1, there is illustrated a photoconductor comprising an optional supporting substrate layer 15, an optional hole blocking layer 17, a photogenerating layer 19 containing photogenerating pigments 23, and a charge transport layer 25 containing a mixture of charge transport compounds 27, and tetraaryl polycarbonates 28.

In FIG. 2, there is illustrated a photoconductor comprising an optional supporting substrate layer 30, an optional hole blocking layer 32, an optionally adhesive layer 34, a photogenerating layer 36 containing inorganic or organic photogenerating pigments 38, and a charge transport layer 40 containing charge transport compounds 42, a tetraaryl polycarbonate copolymer first binder 43 and a second optional binder of a polymer 45, such as a polycarbonate.

Tetraaryl Polycarbonates

Various tetraaryl polycarbonates can be selected for inclusion in the photoconductor charge transport layer or layers of the present disclosure. Examples of tetraaryl polycarbonates selected for the charge transport layer and available from Mitsubishi Chemical Company, are represented by the following formulas/structures

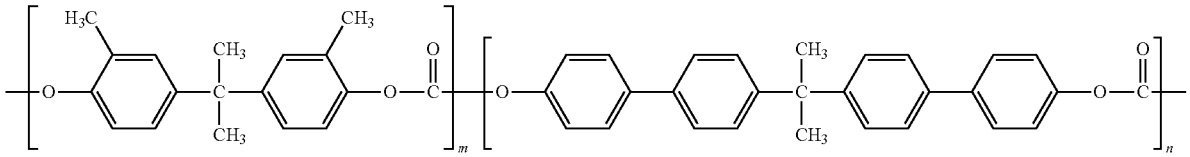

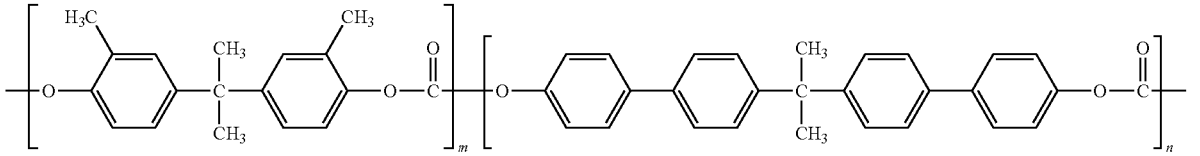

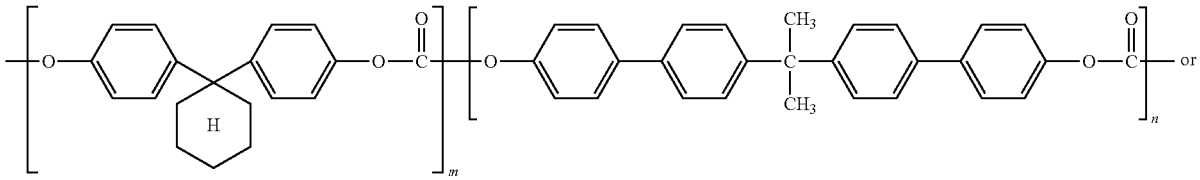

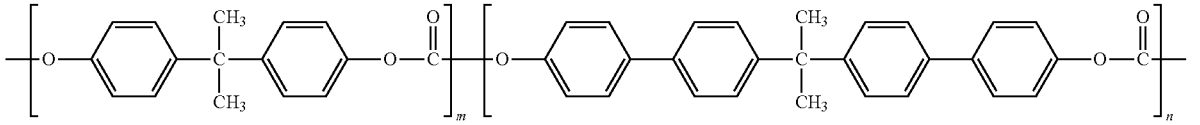

wherein m and n are the mol percents of each segment, respectively, as measured by known methods, and more specifically by NMR, with m being, for example, from about 60 to about 90, from about 60 to about 95, from about 70 to about 90 mol percent, or from about 65 to about 85 mol percent; n being, for example, from about 5 to about 40, from about 10 to about 40, from about 15 to about 35, or from about 10 to about 30 mol percent with the total of m and n being equal to about 100 percent.

Specific examples of tetraaryl polycarbonate copolymers present in the charge transport layer mixture, and which copolymers are available from Mitsubishi Chemical Company, are a bisphenol C-co-tetraaryl bisphenol polycarbonate copolymer, a bisphenol Z-co-tetraaryl bisphenol polycarbonate copolymer, and a bisphenol A-co-tetraaryl bisphenol polycarbonate copolymer represented by the following formulas/structures

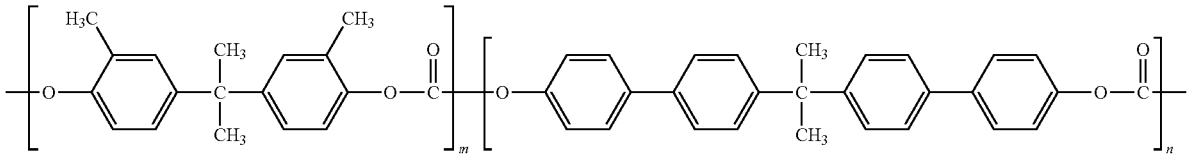

available as C80PPA20; m is 80 mol percent; n is 20 mol percent, and the viscosity average molecular weight (Mv) is 62,300 as determined by GPC analysis;

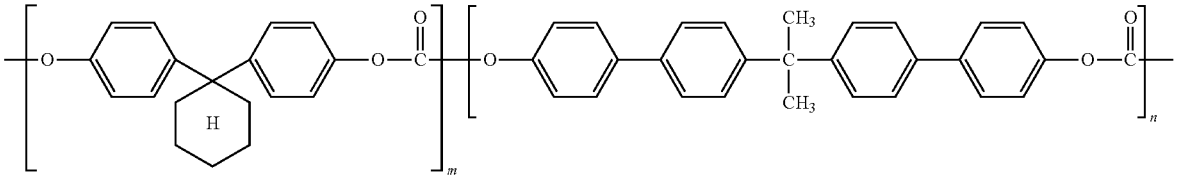

available as Z80PPA20, where m is 80 mol percent, n is 20 mol percent, and the viscosity average molecular weight is 64,600 as determined by GPC analysis; or

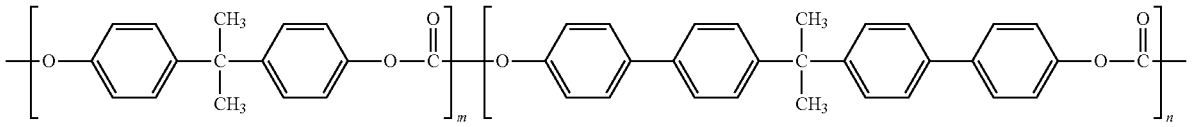

available as A80PPA20, where m is 80 mol percent, n is 20 mol percent, and the viscosity average molecular weight is 62,600.

In the charge transport layer mixture, the tetraaryl polycarbonates illustrated herein can be present in a number of effective amounts, such as for example, from about 40 to about 85 weight percent, from about 45 to about 80, from about 50 to about 75 weight percent, from about 50 to about 70 weight percent, or from about 55 to about 65 weight percent based on the total solids.

The tetraaryl polycarbonates, such as the copolymers thereof, possess, for example, a weight average molecular weight of from about 40,000 to about 70,000 or from about 50,000 to about 60,000, as determined by GPC analysis, and a number average molecular weight of from about 30,000 to about 60,000 or from about 40,000 to about 50,000, as determined by GPC analysis.

Photoconductor Layer Examples

A number of known components can be selected for the various photoconductor layers, such as the supporting substrate layer, the photogenerating layer, the charge transport layer mixture, the ground plane layer when present, the hole blocking layer when present, and the adhesive layer when present.

Supporting Substrates

The thickness of the photoconductor supporting substrate layer depends on many factors, including economical considerations, the electrical characteristics desired, adequate flexibility properties, availability, and cost of the specific components for each layer, and the like, thus this layer may be of a substantial thickness, for example about 2,500 microns, such as from about 100 to about 2,000 microns, from about 400 to about 1,000 microns, or from about 200 to about 600 microns ("about" throughout includes all values in between the values recited), or of a minimum thickness. In embodiments, the thickness of this layer is from about 70 to about 300 microns, or from about 100 to about 175 microns.

The photoconductor substrate may be opaque or substantially transparent, and may comprise any suitable material including known or future developed materials. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, gold, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired, and economical considerations. For a drum, this layer may be of a substantial thickness of, for example, up to many centimeters or of a minimum thickness of less than a millimeter. Similarly, a flexible belt may be of a substantial thickness of, for example, about 250 microns, or of a minimum thickness of less than about 50 microns provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, supporting substrate layers selected for the photoconductors of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®.

Anticurl Layer

In some situations, it may be desirable to coat an anticurl layer on the back of the photoconductor substrate, particularly when the substrate is a flexible organic polymeric material. This anticurl layer, which is sometimes referred to as an anticurl backing layer, minimizes undesirable curling of the substrate. Suitable materials selected for the disclosed photoconductor anticurl layer include, for example, polycarbonates commercially available as MAKROLON®, polyesters, and the like. The anticurl layer can be of a thickness of from about 5 to about 40 microns, from about 10 to about 30 microns, or from about 15 to about 25 microns.

Ground Plane Layer

Positioned on the top side of the supporting substrate, there can be included an optional ground plane such as gold, gold containing compounds, aluminum, titanium, titanium/zirconium, and other suitable known components. The thickness of the ground plane layer can be from about 10 to about 100 nanometers, from about 20 to about 50 nanometers, from about 10 to about 30 nanometers, from about 15 to about 25 nanometers, or from about 20 to about 35 nanometers.

Hole-Blocking Layer

An optional charge blocking layer or hole blocking layer may be applied to the photoconductor supporting substrate, such as to an electrically conductive supporting substrate surface prior to the application of a photogenerating layer. An optional charge blocking layer or hole blocking layer, when present, is usually in contact with the ground plane layer, and also can be in contact with the supporting substrate. The hole blocking layer generally comprises any of a number of known components as illustrated herein, such as metal oxides, phenolic resins, aminosilanes, and the like, and mixtures thereof. The hole blocking layer can have a thickness of from about 0.01 to about 30 microns, from about 0.02 to about 5 microns, or from about 0.03 to about 2 microns.

Examples of aminosilanes included in the hole blocking layer can be represented by the following formulas/structures

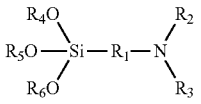

wherein $R_1$ is alkylene, straight chain, or branched containing, for example, from 1 to about 25 carbon atoms, from 1 to about 18 carbon atoms, from 1 to about 12 carbon atoms, or from 1 to about 6 carbon atoms; $R_2$ and $R_3$ are, for example, independently selected from the group consisting of at least one of a hydrogen atom, alkyl containing, for example, from 1 to about 12 carbon atoms, from 1 to about 10 carbon atoms, or from 1 to about 4 carbon atoms; aryl containing, for example, from about 6 to about 24 carbon atoms, from about 6 to about 18 carbon atoms, or from about 6 to about 12 carbon atoms, such as a phenyl group, and a poly(alkylene amino) group, such as a poly(ethylene amino) group, and where $R_4$, $R_5$ and $R_6$ are independently an alkyl group containing, for example, from 1 to about 12 carbon atoms, from 1 to about 10 carbon atoms, or from 1 to about 4 carbon atoms.

Specific examples of suitable hole blocking layer aminosilanes include 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy) silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino) ethylamino]-3-proprionate, (N,N'-dimethyl 3-amino)propyl triethoxysilane, N,N-dimethylaminophenyl triethoxysilane, trimethoxysilyl propyldiethylene triamine, and the like, and mixtures thereof. Specific aminosilanes incorporated into the hole blocking layer are 3-aminopropyl triethoxysilane (γ-APS), N-aminoethyl-3-aminopropyl trimethoxysilane, (N,N'-dimethyl-3-amino)propyl triethoxysilane, or mixtures thereof.

The hole blocking layer aminosilane may be treated to form a hydrolyzed silane solution before being added into the final hole blocking layer coating solution or dispersion. During hydrolysis of the aminosilanes, the hydrolyzable groups, such as the alkoxy groups, are replaced with hydroxyl groups. The pH of the hydrolyzed silane solution can be controlled to from about 4 to about 10, or from about 7 to about 8 to thereby result in photoconductor electrical stability. Control of the pH of the hydrolyzed silane solution may be affected with any suitable material, such as generally organic acids or inorganic acids. Examples of organic and inorganic acids selected for pH control include acetic acid, citric acid, formic acid, hydrogen iodide, phosphoric acid, hydrofluorosilicic acid, p-toluene sulfonic acid, and the like.

The hole blocking layer can, in embodiments, be prepared by a number of known methods, the process parameters being dependent, for example, on the photoconductor member desired. The hole blocking layer can be coated as a solution or a dispersion onto the photoconductor supporting substrate, or on to the ground plane layer by the use of a spray coater, a dip coater, an extrusion coater, a roller coater, a wire-bar coater, a slot coater, a doctor blade coater, a gravure coater, and the like, and dried at, for example, from about 40 to about 200° C. or from 75 to 150° C. for a suitable period of time, such as for example, from about 1 to about 4 hours, from about 1 to about 10 hours, or from about 40 to about 100 minutes in the presence of an air flow. The hole blocking layer coating can be accomplished in a manner to provide a final hole blocking layer thickness after drying of, for example, from about 0.01 to about 30 microns, from about 0.02 to about 5 microns, or from about 0.03 to about 2 microns.

Adhesive Layer

An optional adhesive layer may be included between the photoconductor hole blocking layer and the photogenerating layer. Typical adhesive layer materials selected for the photoconductors illustrated herein, include polyesters, polyurethanes, copolyesters, polyamides, poly(vinyl butyrals), poly (vinyl alcohols), polyacrylonitriles, and the like, and mixtures thereof. The adhesive layer thickness can be, for example, from about 0.001 to about 1 micron, from about 0.05 to about 0.5 micron, or from about 0.1 to about 0.3 micron. Optionally, the adhesive layer may contain effective suitable amounts of from about 1 to about 10 weight percent, or from about 1 to about 5 weight percent of conductive particles such as zinc oxide, titanium dioxide, silicon nitride, and carbon black, nonconductive particles, such as polyester polymers, and mixtures thereof.

Photogenerating Layer

Usually, the disclosed photoconductor photogenerating layer is applied by vacuum deposition or by spray drying onto the supporting substrate, and a charge transport layer or a plurality, from about 2 to about 5 of charge transport layers are formed on the photogenerating layer. The charge transport layer may be situated on the photogenerating layer, the photogenerating layer may be situated on the charge transport layer, or when more than one charge transport layer is present, they can be contained on the photogenerating layer. Also, the photogenerating layer may be applied to any of the layers that are situated between the supporting substrate and the charge transport layer.

Generally, the photogenerating layer can contain known photogenerating pigments, such as metal phthalocyanines, metal free phthalocyanines, alkylhydroxyl gallium phthalocyanines, hydroxygallium phthalocyanines, halogallium phthalocyanines, such as chlorogallium phthalocyanines, perylenes, such as bis(benzimidazo)perylene, titanyl phthalocyanines, especially Type V titanyl phthalocyanine, and the like, and mixtures thereof.

Examples of photogenerating pigments included in the photogenerating layer are vanadyl phthalocyanines, hydroxygallium phthalocyanines, such as Type V hydroxygallium phthalocyanines, high sensitivity titanyl phthalocyanines, Type IV and V titanyl phthalocyanines, quinacridones, polycyclic pigments, such as dibromo anthanthrone pigments, perinone diamines, polynuclear aromatic quinones, azo pigments including bis-, tris- and tetrakis-azos, and the like, and other known photogenerating pigments; inorganic components, such as selenium, selenium alloys, and trigonal selenium; and pigments of crystalline selenium and its alloys.

The photogenerating pigment can be dispersed in a resin binder or alternatively no resin binder need be present. For example, the photogenerating pigments can be present in an optional resinous binder composition in various amounts inclusive of up to from about 99.5 to about 100 weight percent by weight based on the total solids of the photogenerating layer. Generally, from about 5 to about 95 percent by volume of the photogenerating pigment is dispersed in about 95 to about 5 percent by volume of a resinous binder, or from about 20 to about 30 percent by volume of the photogenerating pigment is dispersed in about 70 to about 80 percent by volume of the resinous binder composition. In one embodiment, about 90 percent by volume of the photogenerating pigment is dispersed in about 10 percent by volume of the resinous binder composition.

Examples of polymeric binder materials that can be selected as the matrix or binder for the disclosed photogenerating layer pigments include thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene, acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like, inclusive of block, random, or alternating copolymers thereof.

It is often desirable to select a coating solvent for the disclosed photogenerating layer mixture, and which solvent does not substantially disturb or adversely affect the previously coated layers of the photoconductor. Examples of coating solvents used for the photogenerating layer coating mixture include ketones, alcohols, aromatic hydrocarbons, halogenated aliphatic hydrocarbons, ethers, amines, amides, esters, and the like, and mixtures thereof. Specific solvent examples selected for the photogenerating mixture are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer can be of a thickness of from about 0.01 to about 10 microns, from about 0.05 to about 10 microns, from about 0.2 to about 2 microns, or from about 0.25 to about 1 micron.

Charge Transport Layer

The disclosed charge transport layer or layers, and more specifically, in embodiments, a first or bottom charge transport layer is in contact with the photogenerating layer, and included over the first or bottom charge transport layer a top or second charge transport overcoating layer, comprising charge transporting compounds or molecules dissolved, or molecularly dispersed in a film forming electrically inert polymer such as a polycarbonate. In embodiments, "dissolved" refers, for example, to forming a solution in which the charge transport molecules are dissolved in a polymer to form a homogeneous phase; and molecularly dispersed refers, for example, to charge transporting molecules or compounds dispersed on a molecular scale in a polymer.

In embodiments, charge transport refers, for example, to charge transporting molecules that allows the free charges generated in the photogenerating layer to be transported across the charge transport layer. The charge transport layer is usually substantially nonabsorbing to visible light or radiation in the region of intended use, but is electrically active in that it allows the injection of photogenerated holes from the photoconductive layer, or photogenerating layer, and permits these holes to be transported to selectively discharge surface charges present on the surface of the photoconductor.

A number of charge transport compounds can be included in the tetraaryl polycarbonate charge transport layer mixture or in at least one charge transport layer where at least one charge transport layer is from 1 to about 4 layers, from 1 to about 3 layers, 2 layers, or 1 layer. Examples of charge transport components or compounds present in an amount of from about 15 to about 50 weight percent, from about 35 to about 45 weight percent, or from about 40 to about 45 weight percent based on the total solids of the at least one charge transport layer are the compounds as illustrated in Xerox Corporation U.S. Pat. No. 7,166,397, the disclosure of which is totally incorporated herein by reference, and more specifically, aryl amine compounds or molecules selected from the group consisting of those represented by the following formulas/structures

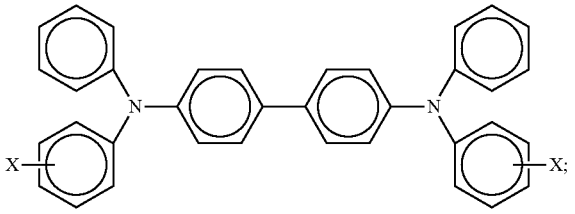

and

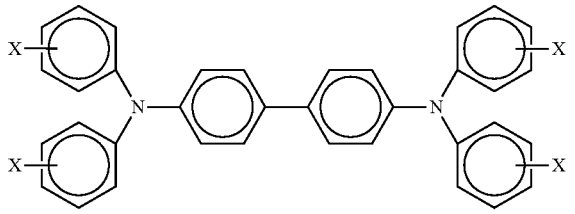

wherein X is a suitable hydrocarbon like alkyl, alkoxy, aryl, isomers thereof, and derivatives thereof like alkylaryl, alkoxyaryl, arylalkyl; a halogen, or mixtures of a suitable hydrocarbon and a halogen; and charge transport layer compounds as represented by the following formula/structure

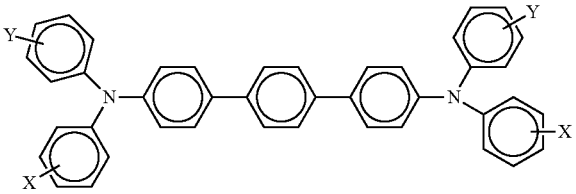

wherein X and Y are independently alkyl, alkoxy, aryl, a halogen, or mixtures thereof.

Alkyl and alkoxy for the photoconductor charge transport layer compounds illustrated herein contain, for example, from about 1 to about 25 carbon atoms, from about 1 to about 12 carbon atoms, or from about 1 to about 6 carbon atoms, such as methyl, ethyl, propyl, butyl, pentyl, hexyl, heptyl, octyl, nonyl, decyl, undecyl, dodecyl, pentadecyl, and the like, and the corresponding alkoxides. Aryl substituents for the charge transport layer compounds can contain from 6 to about 36, from 6 to about 24, from 6 to about 18, or from 6 to about 12 carbon atoms, such as phenyl, naphthyl, anthryl, and the like. Halogen substituents for the charge transport layer compounds include chloride, bromide, iodide, and fluoride. Substituted alkyls, substituted alkoxys, and substituted aryls can also be selected for the disclosed charge transport layer compounds.

Examples of specific aryl amines present in at least one photoconductor charge transport layer include N,N,N',N'-tetra-p-tolyl-1,1'-biphenyl-4,4'-diamine, N,N'-diphenyl-N,N'-bis(alkylphenyl)-1,1'-biphenyl-4,4'-diamine wherein alkyl is selected from the group consisting of methyl, ethyl, propyl, butyl, hexyl, heptyl, octyl, nonyl, decyl, undecyl, dodecyl, pentadecyl, and the like, N,N'-diphenyl-N,N'-bis(halophenyl)-1,1'-biphenyl-4,4'-diamine wherein the halo substituent is chloro, N,N'-bis(4-butylphenyl)-N,N'-di-p-tolyl-[p-terphenyl]-4,4'-diamine, N,N'-bis(4-butylphenyl)-N,N'-di-m-tolyl[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, and the like, hydrazones such as N-phenyl-N-methyl-3-(9-ethyl)carbazyl hydrazone and 4-diethyl amino benzaldehyde-1,2-diphenyl hydrazine, or oxadiazoles such as 2,5-bis(4-N,N'-diethylaminophenyl)-1,2,4-oxadiazole, stilbenes, and the like.

Various processes may be used to mix, and thereafter, apply the charge transport layer or layers coating mixture to the photogenerating layer. Typical charge transport layer application techniques include spraying, dip coating, roll coating, wire wound rod coating, and the like. Drying of the deposited charge transport layer coating or plurality of coatings may be affected by any suitable conventional technique such as oven drying, infrared radiation drying, air drying, and the like.

The thickness of the charge transport layer or charge transport layers, in embodiments, is from about 5 to about 70 microns, from about 20 to about 65 microns, from about 15 to about 50 microns, or from about 10 to about 40 microns, but thicknesses outside this range may, in embodiments, also be selected. The charge transport layer should be an insulator to the extent that an electrostatic charge placed on the charge transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances about 400:1.

Examples of optional second binders, in addition to the tetraaryl polycarbonates to for example permit enhanced miscibility with the hole transport component selected for the disclosed photoconductor charge transport layers, include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof, and more specifically polycarbonates such as poly(4,4'-isopropylidene-diphenylene) carbonate (also referred to as bisphenol-A-polycarbonate), poly(4,4'-cyclohexylidine diphenylene) carbonate (also referred to as bisphenol-Z-polycarbonate), poly(4,4'-isopropylidene-3,3'-dimethyl-diphenyl) carbonate (also referred to as bisphenol-C-polycarbonate), and the like. In embodiments, electrically inactive second resin binders are comprised of polycarbonate resins with a weight average molecular weight of from about 20,000 to about 100,000, or with a weight average molecular weight $M_w$ of from about 50,000 to about 100,000. Generally, the transport layer contains from about 10 to about 75 percent by weight of the charge transport material, and more specifically, from about 35 to about 50 percent of this material.

In embodiments, the charge transport compound can be represented by the following formulas/structures

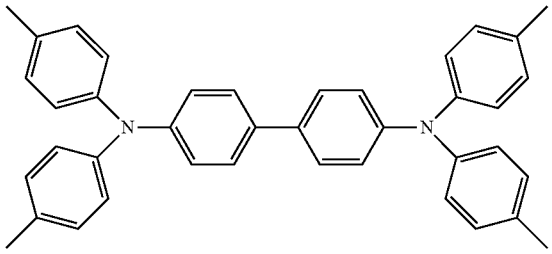

;

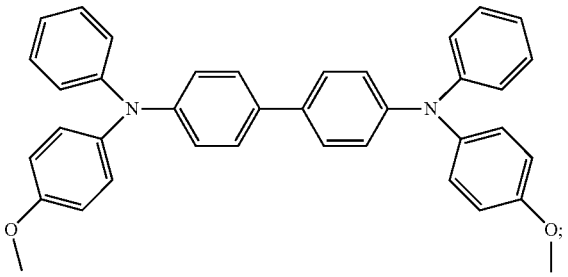

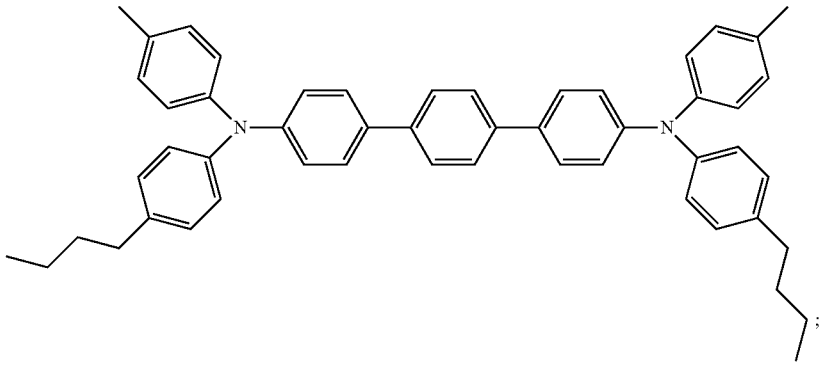

;

-continued

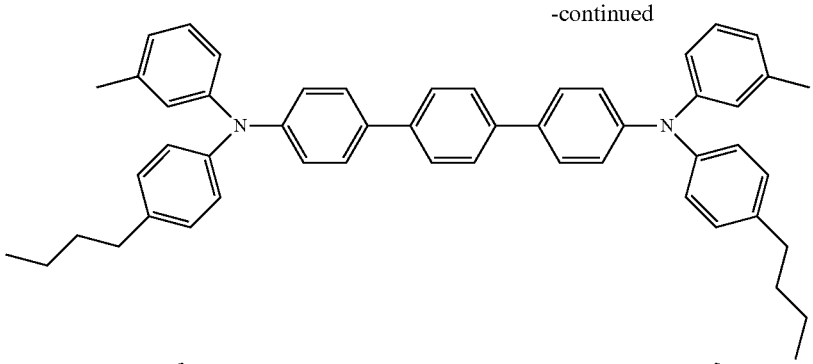

; and

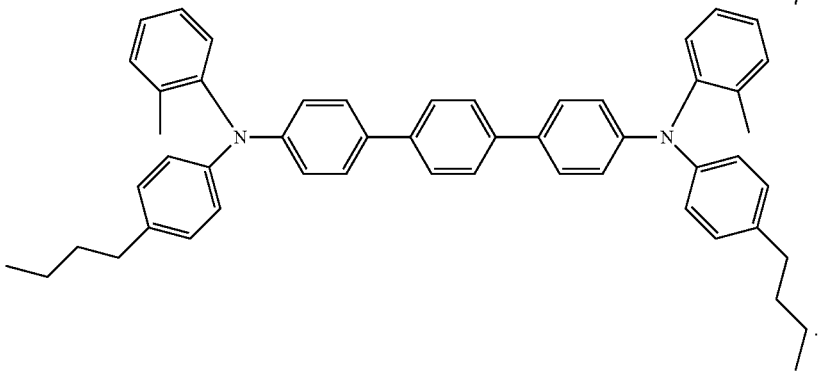

Examples of components or materials optionally incorporated into at least one charge transport layer to, for example, enable excellent lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NR, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20 weight percent, from about 1 to about 10 weight percent, or from about 3 to about 8 weight percent.

The photoconductor wear rates when selecting for the charge transport layer a mixture of a charge transport compound and the tetraaryl polycarbonates illustrated herein is, for example, reduced by from about 30 to about 70 percent, and more specifically, from about 40 to about 60 weight percent as compared to a similar known photoconductor that is free of the charge transport layer tetraaryl polycarbonate. Thus, the tetraaryl polycarbonate containing photoconductor wear rate, measured using an in-house known wear fixture as illustrated herein is from about 30 to about 55, or from about 35 to about 50 nanometers/kilocycles.

In addition to improved wear characteristics, the disclosed photoconductors have color print stability and excellent cyclic stability of almost no or a minimal change in a generated known photoinduced discharge curve (PIDC), especially no or minimal residual potential cycle up after a number of charge/discharge cycles of the photoconductor, for example about 100 kilocycles, or xerographic prints of, for example, from about 80 to about 100 kiloprints. Color print stability refers, for example, to substantially no or minimal change in solid area density, especially in 60 percent halftone prints, and no or minimal random color variability from print to print after a number of xerographic prints, for example 50 kiloprints.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of a thermoplastic resin, a colorant, such as a pigment, dye, or mixtures thereof, a charge additive, internal additives like waxes, and surface additives, such as for example silica, coated silicas, aminosilanes, and the like, reference U.S. Pat. Nos. 4,560,635 and 4,338,390, the disclosures of each of these patents being totally incorporated herein by reference, subsequently transferring the toner image to a suitable image receiving substrate, and permanently affixing the image thereto. In those environments wherein the photoconductor is to be used in a printing mode, the imaging method involves the same operation with the exception that exposure can be accomplished with a laser device or image bar. More specifically, the flexible photoconductor belts disclosed herein can be selected for the Xerox Corporation iGEN® machines that generate with some versions over 110 copies per minute. Processes of imaging, especially xerographic imaging and printing, including digital and/or color printing, are thus encompassed by the present disclosure.

The imaging members or photoconductors illustrated herein are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed, for example at least 100 copies per minute, color copying and printing processes.

The following Examples are being submitted to illustrate embodiments of the present disclosure. Molecular weights were determined by Gel Permeation analysis. The ratios recited were determined primarily by the amount of components selected for the preparations indicated.

Comparative Example 1

An undercoat layer was prepared, and then deposited on a 30 millimeter thick aluminum drum substrate as follows.

Zirconium acetylacetonate tributoxide (35.5 parts), γ-aminopropyl triethoxysilane (4.8 parts), and poly(vinyl butyral) BM-S (2.5 parts) were dissolved in n-butanol (52.2 parts). The resulting solution was then coated by a dip coater on the above 30 millimeter thick aluminum drum substrate, and the coating solution layer was pre-heated at 59° C. for 13 minutes, humidified at 58° C. (dew point=54° C.) for 17 minutes, and dried at 135° C. for 8 minutes. The thickness of the resulting undercoat layer was approximately 1.3 microns.

A photogenerating layer, 0.2 micron in thickness, comprising chlorogallium phthalocyanine (Type C) was deposited on the above undercoat layer. The photogenerating layer coating dispersion was prepared as follows. 2.7 Grams of chlorogallium phthalocyanine (ClGaPc) Type C pigment were mixed with 2.3 grams of the polymeric binder (carboxyl-modified vinyl copolymer, VMCH, available from Dow Chemical Company, 15 grams of n-butyl acetate, and 30 grams of xylene. The resulting mixture was mixed in an Attritor mill with about 200 grams of 1 millimeter Hi-Bea borosilicate glass beads for about 3 hours. The dispersion mixture obtained was then filtered through a 20 micron Nylon cloth filter, and the solids content of the dispersion was diluted to about 6 weight percent.

Subsequently, a 32 micron charge transport layer was coated on top of the above photogenerating layer from a solution prepared by dissolving N,N-diphenyl-N,N-bis(3-methylphenyl)-1,1'-biphenyl-4,4'-diamine (mTBD, 4 grams), and a film forming polymer binder PCZ-400[poly(4,4'-dihydroxy-diphenyl-1-1-cyclohexane carbonate), $M_w$=40,000] available from Mitsubishi Gas Chemical Company, Ltd. (6 grams), and 0.1 gram of a butylated hydroxytoluene (BHT), in a 70/30 solvent mixture of tetrahydrofuran (THF)/toluene, followed by drying in an oven at about 120° C. for about 40 minutes. The resulting charge transport layer PCZ-400/mTBD/BHT ratio was 59.4/39.6/1.

Example I

A photoconductor was prepared by repeating the process of Comparative Example 1 except that the 32 micron thick charge transport layer was coated on top of the photogenerating layer from a solution prepared from a mixture of N,N'-diphenyl-N,N-bis(3-methylphenyl)-1,1'-biphenyl-4,4'-diamine (mTBD), 39.6 weight percent, 59.4 weight percent of the tetraaryl polycarbonate copolymer obtained from Mitsubishi Chemical Company and identified herein as C80PPA20, where m is 80 mol percent and n is 20 mol percent, and the viscosity average molecular weight was 62,300 as determined by GPC analysis, and 1 weight percent of the butylated hydroxytoluene (BHT) dissolved in a solvent mixture of tetrahydrofuran/toluene 70/30. The 32 micron thick charge transport layer resulting comprised C80PPA20/mTBD/BHT in a 59.4/39.6/1 ratio.

Electrical Property Testing

The above prepared photoconductors of Comparative Example 1 and Example I were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The above photoconductors were tested at surface potentials of 700 volts with the exposure light intensity incrementally increased by means of regulating a series of neutral density filters; and the exposure light source was a 780 nanometer light emitting diode. The xerographic simulation was completed in an environmentally controlled light tight chamber at ambient conditions (40 percent relative humidity and 22° C.).

Substantially similar PIDCs were obtained for the above two photoconductors. Therefore, the incorporation of the above tetraaryl polycarbonate of Example I did not adversely affect the electrical properties of this photoconductor.

Wear Testing

Wear tests of the photoconductors of Comparative Example 1 and Example I were performed using an in house wear test fixture (biased charging roll, and BCR charging with peak to peak voltage of 1.8 kilovolts). The total thickness of each photoconductor was measured via Permascope before each wear test was initiated. Then the photoconductors were separately placed into the wear fixture for 100 kilocycles. The total photoconductor thickness was measured again with the Permascope, and the difference in thickness was used to calculate wear rate (nanometers/kilocycle) of the photoconductors. The smaller the wear rate, the more wear resistant was the photoconductor.

There resulted an improved wear rate of 46.0 nm/kcycle for the Example I photoconductor versus a wear rate of 65.8 nm/kcycle for the Comparative Example 1 photoconductor, which represents a 67 percent wear rate improvement for the Example I photoconductor.

Thus, it is expected, in accordance with the principles of the teachings of the present disclosure, that photoconductors possessing wear rates of from about 35 to about 55 nm/kcycle, from about 40 to about 50 nm/kcycle, or better can be achieved.

Example II

Two photoconductors are prepared by repeating the process of Example I except that the tetraaryl polycarbonate copolymer C80PPA20 is replaced with Z80PPA20, where m is 80 mol percent, n is 20 mol percent, and the viscosity average molecular weight is 64,600 as determined by GPC analysis, and A80PPA20, where m is 80 mol percent, n is 20 mol percent and the viscosity average molecular weight is 62,600.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a supporting substrate, a photogenerating layer, and a charge transport layer, and wherein said charge transport layer contains a charge transport compound and a polycarbonate copolymer selected from the group consisting of those represented by the following formulas/structures

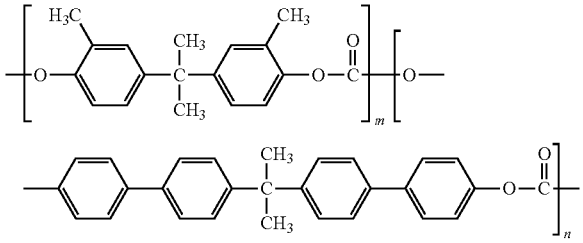

-continued

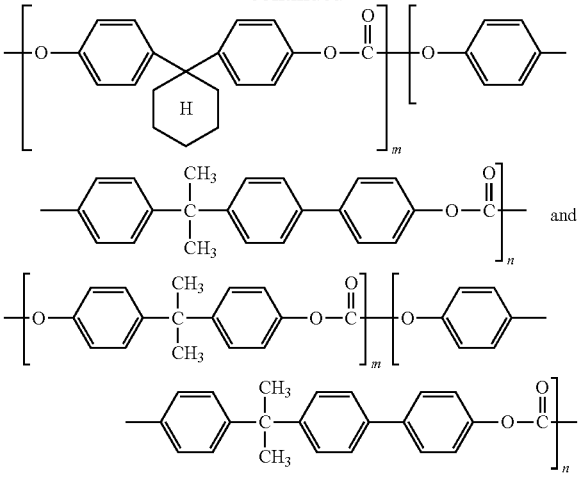

and wherein m and n represent the mol percents of each segment, and wherein the total thereof is about 100 percent, m being from about 60 to about 90 mol percent, and n being from about 10 to about 40 mol percent.

2. A photoconductor in accordance with claim 1 further containing a hindered phenolic antioxidant.

3. A photoconductor in accordance with claim 1 wherein m is from about 65 to about 85 mol percent, and n is from about 15 to about 35 mol percent.

4. A photoconductor in accordance with claim 1 wherein said copolymer is represented by the following formulas/structures

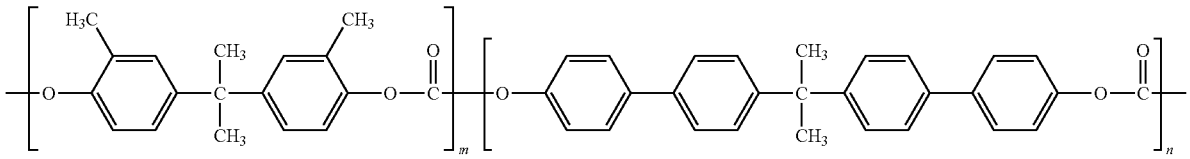

wherein m is from about 65 to about 85 mole percent, and n is from about 15 to about 35 mol percent.

5. A photoconductor in accordance with claim 1 wherein said copolymer is represented by the following formulas/structures

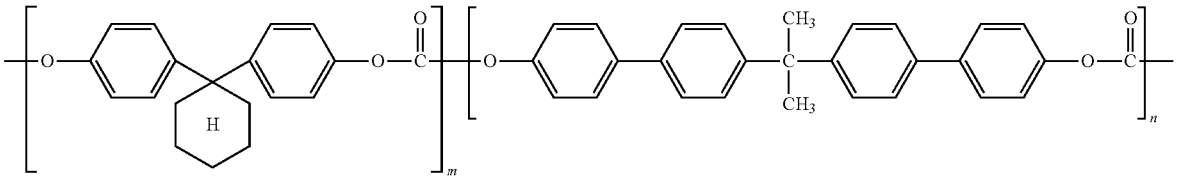

wherein m is from about 65 to about 85 mole percent, and n is from about 15 to about 35 mol percent.

6. A photoconductor in accordance with claim 1 wherein said copolymer is represented by the following formulas/structures

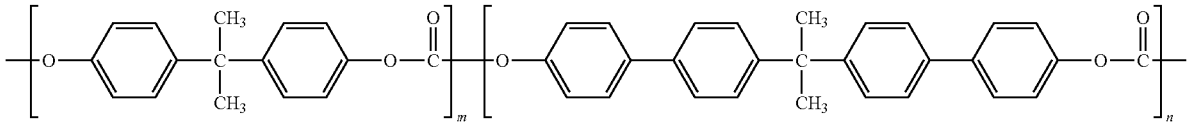

wherein m is from about 65 to about 85 mole percent, and n is from about 15 to about 35 mol percent.

7. A photoconductor in accordance with claim 1 wherein said copolymer possesses a weight average molecular weight of from about 40,000 to about 70,000, and a number average molecular weight of from about 30,000 to about 60,000 as determined by GPC analysis.

8. A photoconductor in accordance with claim 1 wherein said copolymer is present in an amount of from about 45 to about 80 weight percent.

9. A photoconductor in accordance with claim 1 wherein said copolymer is present in an amount of from about 50 to about 70 weight percent.

10. A photoconductor in accordance with claim 1 wherein said charge transport layer is comprised of a first charge transport layer in contact with said photogenerating layer, and a second charge transport layer in contact with said first charge transport layer, and wherein said copolymer is present in said second charge transport layer.

11. A photoconductor in accordance with claim 1 wherein said charge transport compound is represented by at least one of

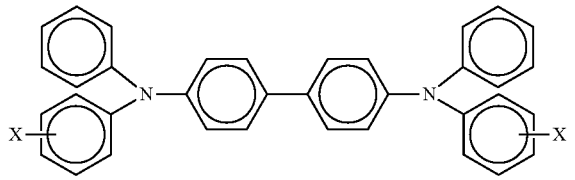

-continued

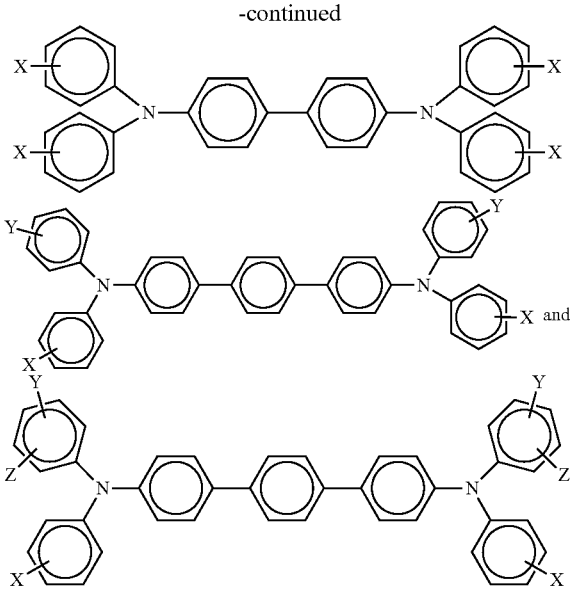

wherein X, Y, and Z are independently selected from the group consisting of alkyl, alkoxy, aryl, halogen, and mixtures thereof.

12. A photoconductor in accordance with claim 1 wherein said charge transport compound is selected from the group consisting of N,N'-bis(methylphenyl)-1,1-biphenyl-4,4'-diamine, tetra-p-tolyl-biphenyl-4,4'-diamine, N,N'-diphenyl-N,N'-bis(4-methoxyphenyl)-1,1-biphenyl-4,4'-diamine, N,N-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine.

13. A photoconductor in accordance with claim 1 wherein said photogenerating layer is comprised of at least one photogenerating pigment.

14. A photoconductor in accordance with claim 1 wherein said photogenerating layer is comprised of at least one of a titanyl phthalocyanine, a hydroxygallium phthalocyanine, a halogallium phthalocyanine, a bisperylene, and mixtures thereof.

15. A photoconductor comprised in sequence of a supporting substrate, a hole blocking layer thereover, a photogenerating layer, and a charge transport layer comprised of a mixture of an aryl amine hole transport compound and a polycarbonate as represented by the following formulas/structures

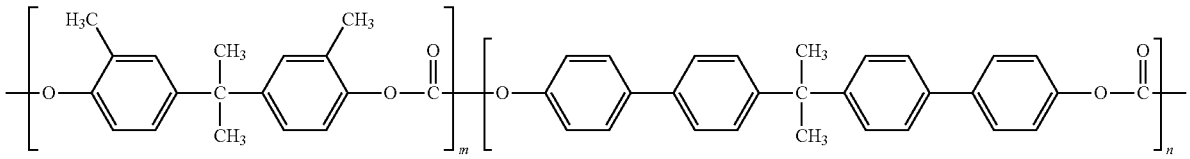

wherein m is from about 65 to about 85 mol percent, and n is from about 15 to about 35 mol percent, and the total thereof is 100 mol percent.

16. A photoconductor in accordance with claim 15 wherein said aryl amine is N,N'-diphenyl-N,N-bis(3-methylphenyl)-1,1'-biphenyl-4,4'-diamine, said m is from about 70 to about 80 mol percent, and said n is from about 20 to about 30 mol percent.

17. A photoconductor in accordance with claim 15 wherein said hole blocking layer is comprised of an aminosilane of at least one of 3-aminopropyl triethoxysilane, N,N-dimethyl-3-aminopropyl triethoxysilane, N-phenylaminopropyl trimethoxysilane, triethoxysilylpropylethylene diamine, trimethoxysilylpropylethylene diamine, trimethoxysilylpropyldiethylene triamine, N-aminoethyl-3-aminopropyl trimethoxysilane, N-2-aminoethyl-3-aminopropyl trimethoxysilane, N-2-aminoethyl-3-aminopropyl tris(ethylethoxy)silane, p-aminophenyl trimethoxysilane, N,N'-dimethyl-3-aminopropyl triethoxysilane, 3-aminopropylmethyl diethoxysilane, 3-aminopropyl trimethoxysilane, N-methylaminopropyl triethoxysilane, methyl[2-(3-trimethoxysilylpropylamino)ethylamino]-3-proprionate, (N,N'-dimethyl 3-amino)propyl triethoxysilane, N,N-dimethylaminophenyl triethoxysilane, trimethoxysilyl propyldiethylene triamine, and mixtures thereof.

18. A photoconductor comprising a supporting substrate, a hole blocking layer thereover, a photogenerating layer, and a hole transport layer comprised of a mixture of a hole transport compound and a polycarbonate copolymer selected from the group consisting of those represented by the following formulas/structures

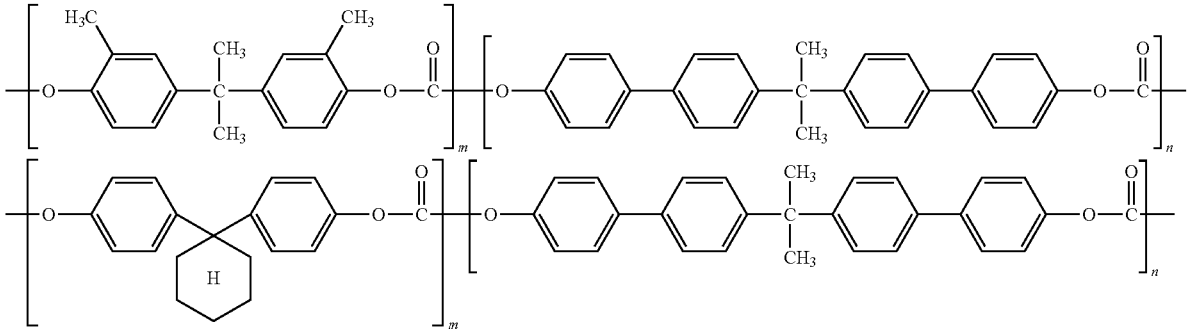
and
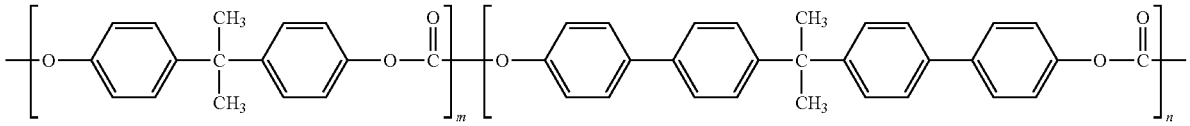
wherein m and n represent the mol percents of each segment, and wherein the total thereof is about 100 percent, m being from about 60 to about 95 mol percent, and n being from about 5 to about 40 mol percent.
* * * * *